US008766522B1

(12) United States Patent
Fairchild et al.

(10) Patent No.: US 8,766,522 B1
(45) Date of Patent: Jul. 1, 2014

(54) CARBON NANOTUBE FIBER CATHODE

(75) Inventors: Steven B Fairchild, Dayton, OH (US); Benji Maruyama, Yellow Springs, OH (US)

(73) Assignee: The United States of America as represented by the Secretary of the Air Force, Washington, DC (US)

( * ) Notice: Subject to any disclaimer, the term of this patent is extended or adjusted under 35 U.S.C. 154(b) by 305 days.

(21) Appl. No.: 13/105,249

(22) Filed: May 11, 2011

Related U.S. Application Data

(60) Provisional application No. 61/350,624, filed on Jun. 2, 2010.

(51) Int. Cl.

| | |
|---|---|
| ***H01J 1/14*** | (2006.01) |
| ***H01J 1/304*** | (2006.01) |
| ***H01J 29/46*** | (2006.01) |
| ***H01J 1/28*** | (2006.01) |

(52) U.S. Cl.

CPC ..... *H01J 1/28* (2013.01); *H01J 2201/30469* (2013.01); *H01J 1/304* (2013.01); *H01J 29/467* (2013.01); *H01J 2329/0455* (2013.01); *H01J 2329/0431* (2013.01); *H01J 1/3042* (2013.01); *H01J 2201/304* (2013.01)

USPC ..... 313/346 R; 313/495; 313/355; 313/351; 313/306

(58) Field of Classification Search

CPC ..... H01J 2201/30469; H01J 2201/304; H01J 2201/30407; H01J 2201/30434; H01J 2329/0431; H01J 2329/0455; H01J 31/127; H01J 31/15; H01J 29/028; H01J 29/085; H01J 29/864; H01J 29/467; H01J 3/022; H01J 63/06; H01J 9/025; H01J 9/042; H01J 21/02; H01J 21/105; H01J 1/3042; H01J 1/304; H01J 1/28; H01J 1/14; H01J 1/142; H01J 1/20; H01J 19/30; H01J 17/066; B82Y 10/00; B23K 35/0261; B03C 3/41; B03C 7/06

USPC ..... 313/495–497, 306, 309–310, 346, 351, 313/355

See application file for complete search history.

(56) References Cited

U.S. PATENT DOCUMENTS

| | | | | |
|---|---|---|---|---|
| 5,973,444 | A | 10/1999 | Xu et al. | |
| 6,006,003 | A * | 12/1999 | Kim | 385/147 |
| 6,299,812 | B1 | 10/2001 | Newman et al. | |
| 6,440,761 | B1 | 8/2002 | Choi | |
| 6,440,763 | B1 * | 8/2002 | Hsu | 438/20 |

(Continued)

OTHER PUBLICATIONS

Yuji Morihisa, et al, Improved field emission characteristics of individual carbon nanotube coated with boron nitride nanofilm, J. Vac. Sci. Technol, Mar./Apr. 2008, pp. 872-875.

(Continued)

*Primary Examiner* — Nimeshkumar Patel
*Assistant Examiner* — Jose M Diaz
(74) *Attorney, Agent, or Firm* — AFMCLO/JAZ; Charles Figer, Jr.

(57) ABSTRACT

Improved field emission cathodes comprise a fiber of highly aligned and densely packed single-wall carbon nanotubes, double-wall carbon nanotubes, multi-wall carbon nanotubes, grapheme nanoribbons, carbon nanofibers, and/or carbon planar nanostructures. The fiber cathodes provide superior current carrying capacity without degradation or adverse effects under high field strength testing. The fibers also can be configured as multi-fiber field emission cathodes, and the use of low work function coatings and different tip configurations further improves their performance.

14 Claims, 7 Drawing Sheets

(56) References Cited

U.S. PATENT DOCUMENTS

| | | | | |
|---|---|---|---|---|
| 6,504,292 | B1 * | 1/2003 | Choi et al. | 313/310 |
| 6,512,235 | B1 | 1/2003 | Eitan et al. | |
| 6,628,053 | B1 | 9/2003 | Den et al. | |
| 6,741,019 | B1 * | 5/2004 | Filas et al. | 313/355 |
| 6,900,580 | B2 | 5/2005 | Dai et al. | |
| 6,914,372 | B1 | 7/2005 | Akiyama et al. | |
| 6,975,063 | B2 * | 12/2005 | Mao et al. | 313/309 |
| 6,979,709 | B2 | 12/2005 | Smalley et al. | |
| 7,008,563 | B2 | 3/2006 | Smalley et al. | |
| 7,105,596 | B2 | 9/2006 | Smalley et al. | |
| 7,125,502 | B2 | 10/2006 | Smalley et al. | |
| 7,202,596 | B2 | 4/2007 | Tang et al. | |
| 7,221,087 | B2 | 5/2007 | Liu et al. | |
| 7,335,395 | B2 | 2/2008 | Ward et al. | |
| 7,355,334 | B2 | 4/2008 | Anazawa et al. | |
| 7,368,823 | B1 | 5/2008 | Horibe et al. | |
| 7,375,366 | B2 | 5/2008 | Ohki et al. | |
| 7,432,883 | B2 | 10/2008 | Oyama et al. | |
| 7,462,498 | B2 | 12/2008 | Mao et al. | |
| 7,741,765 | B2 * | 6/2010 | Liu et al. | 313/311 |
| 7,868,531 | B2 * | 1/2011 | Liang | 313/336 |
| 8,450,920 | B2 * | 5/2013 | Wei et al. | 313/496 |
| 2002/0125805 | A1 * | 9/2002 | Hsu | 313/309 |
| 2004/0026629 | A1 * | 2/2004 | Fujieda et al. | 250/423 R |
| 2004/0245904 | A1 * | 12/2004 | Kitamura et al. | 313/310 |
| 2005/0244991 | A1 | 11/2005 | Mao et al. | |
| 2007/0104867 | A1 | 5/2007 | Haba | |
| 2008/0012461 | A1 | 1/2008 | Yaniv et al. | |
| 2008/0029700 | A1 * | 2/2008 | Fujieda et al. | 250/310 |
| 2008/0036358 | A1 * | 2/2008 | Takai | 313/495 |
| 2008/0067494 | A1 * | 3/2008 | Mammana et al. | 257/10 |
| 2008/0170982 | A1 * | 7/2008 | Zhang et al. | 423/447.3 |
| 2009/0117674 | A1 | 5/2009 | Wei et al. | |
| 2009/0134772 | A1 * | 5/2009 | Wei et al. | 313/495 |
| 2010/0005553 | A1 * | 1/2010 | Jin et al. | 850/58 |
| 2010/0190407 | A1 * | 7/2010 | Wei et al. | 445/23 |

OTHER PUBLICATIONS

Jihua Zhan, et al, Improvement of the field emission of Carbon Nanotubes by Hafnium Coating and Annealing, Institute of Physics Publishing Nanotechnology, Dec. 5, 2005, pp. 257-260.

W.I. Miline, et al, Aligned Carbon Nanotubes/Fibers for applications in Vacuum Microwave Amplifiers, J. Vac. Sci, Technol, Jan./Feb. 2006, pp. 345-348.

Y. Tu, et al, Nanoelectrode Arrays based on low site density aligned Carbon Nanotubes, Nano Lett., vol. 3, No. 1, 2003, pp. 107-109, American Chemical Society.

Don A. Shiffler, et al, Comparison of Carbon Fiber and Cesium Iodide-Coated Carbon Fiber Cathodes, IEEE Transactions on Plasma Science, vol. 28, No. 3, Jun. 2000.

Lujun Pan, et al, Field Emission Properties of Titanium Carbide coated carbon Nanotube Arrays, Advanced Engineering Materials 2007, 9, No. 7, pp. 584-587.

Zhong L. Wang, et al, In situ Imaging of Field Emission from Individual Carbon Nanotubes and their Structural Damage, Applied Physics Letters vol. 80 No. 5, Feb. 4, 2002, pp. 856-858.

Yi Wei, et al, Stability of Carbon Nanotubes under Electric Field studied by scanning Eletron Microscopy, Applied Physics Letters vol. 79 No. 27, Dec. 31, 2001, pp. 4527-4529.

Jian Zhang, et al, Efficient Fabrication of Carbon Nanotube Point Electron sources by Dielectrophoresis, Adv. Mater. 16, No. 14, Jul. 19, 2004, pp. 1219-1222.

Otto Zhou, et al, Materials Science of Carbon Nanotubes: Fabrication, Integration, and Properties of Macroscopic Structures of Carbon Nanotubes, Accounts of Chemical Research vol. 35, No. 12, 2002, pp. 1045-1053.

* cited by examiner

CARBON NANOTUBE FIBER CATHODE

CROSS-REFERENCE TO RELATED APPLICATIONS

This application claims the benefit of U.S. Provisional Application No. 61/350,624, which was filed in the U.S. Patent and Trademark Office on Jun. 2, 2010.

RIGHTS OF THE GOVERNMENT

The invention described herein may be manufactured and used by or for the Government of the United States for all governmental purposes without the payment of any royalty.

BACKGROUND

Carbon nanotubes are used as electron sources due to their large aspect ratio, high conductivity, and the low field strengths needed to extract current. Among their uses is as field emission cathodes. Typical cathode arrangements involve films consisting of tangled, spaghetti-like carbon nanotubes or loose carpets of vertically aligned carbon nanotubes that have a typical density of 1-5% of their theoretical maximum density. Both configurations are derived from catalyst-induced growth of carbon nanotubes on a substrate. Although a single carbon nanotube can emit over 1 μA, obtaining high current densities from a large area carbon nanotube cathode is difficult to achieve. The problem with large area carbon nanotube cathode films comprising a plurality of individual carbon nanotubes is that the number of emission sites is limited by screening effects of the individual nanotubes and this in turn limits the current density of such large arrays. Currents also can be unstable under high field strengths. These limitations have prevented the realization of macroscopic carbon nanotube cathodes for high energy vacuum electronic applications. As a result, researchers continue to explore ways to use carpets and forests of single nanotubes as field emission cathodes for high energy applications. These initiatives include efforts to decrease the density of the single nanotubes to prevent or at least reduce their screening effects and thereby enhance the field concentration of these arrays of individual carbon nanotube emitters.

In certain vacuum electronic applications, electron beams of smaller diameter (<100 μm) and high current density (several mA) are required. For example, field emission DC cold cathodes find use for electron microscopy, novel x-ray sources, vacuum electronic devices, THz sources, and high power microwave tubes. Each of these applications typically requires high current densities with a high brightness electron beams driven by cathodes exhibiting long lifetime in the presence of deleterious conditions such as ion back bombardment and excessive heating. Small diameter (<50 μm) graphite fibers have been studied for these applications but they have not demonstrated the required robustness. They typically suffer serious degradation due to joule heating and produce at the most several hundred microamps before failure after tens of hours of operation. Similarly, carbon nanotube yarns that are spun from largely unaligned, multi-wall nanotubes are not durable enough for use as field emission cathodes due to their low density and the fact that they quickly degrade under high field testing.

SUMMARY OF INVENTION

The disclosed field emission cathodes overcome these limitations and provide superior, unprecedented performance in high energy applications. They handle much higher current densities and voltages than existing carbon nanotube field emission cathodes while suffering minimal damage and performance loss. The field emission cathodes disclosed herein comprise fibers of highly aligned, densely packed single-walled carbon nanotubes (SWNTs). These fiber cathodes provide superior current carrying capability without degradation or adverse effects under high field strength testing. Cathodes can be configured as single fibers or multiple fibers. Use of coatings and different field tip configurations further improves the performance of these fiber cathodes that provide heretofore unachievable currents in field emission cathodes and maintain this level of performance indefinitely without degradation or loss of performance.

A method of making a field emission cathode comprises the steps of: spin solutions of nanotubes in a superacid into different coagulants to form a fiber of densely-packed nanotubes that are highly aligned along a longitudinal axis of the fiber; coating the fiber with a low work function coating; and forming a tip at one end of the fiber.

An improved field emission cathode for high energy applications comprises: a fiber of densely-packed carbon nanotubes that are highly aligned along a longitudinal axis of the fiber; a low work function coating that is applied to the fiber; and a tip that is formed at one end of the fiber.

An improved cathode array comprises: a substrate; a plurality of cathodes formed on one surface of the substrate; and a coating of carbon nanotubes which covers tip of each cathode. The coating of carbon nanotubes may not be aligned with the field direction.

DETAILED DESCRIPTION

Figure 1:
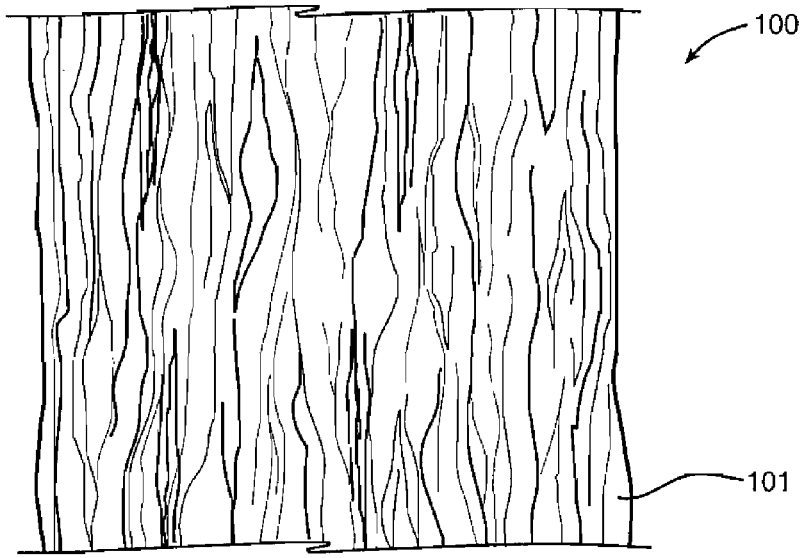
FIG. 1 shows a field emission fiber cathode.

The disclosed fiber cathodes may be formed from a variety of materials. They may be formed from single-wall nanotubes (SWNTs) by spinning solutions of SWNTs in a superacid into different coagulants to form a fiber, as disclosed in U.S. Pat. No. 7,125,502 B2, the entire contents of which are incorporated herein by reference. As shown in FIG. 1, such a fiber 100 comprises a plurality of densely-packed SWNTs 101 that are highly-aligned along an axial direction of the fiber 100. The fiber 100 can have varying diameters depending on the number of SWNTs that are spun together and may be, for example, about 40 to 400 microns in diameter and have carbon nanotube densities of about 50% to about 100% and preferably of about 70% to about 100% of the theoretical maximum density of nanotubes. The fiber 100 may comprise a plurality of densely-packed double-wall carbon nanotubes, multi-wall carbon nanotubes, graphene nanoribbons, and/or carbon nanofibers in addition to, or in lieu of, the SWNTs (herein referred to as nanocarbons). The fiber 100 also may comprise nanocarbons in planar nanostructures that are spun or formed into a densely-packed fiber or formed into a planar or conformal structure onto a flat or shaped substrate via typical film forming processes such as screen printing, solution casting, and the like.

Figure 2:
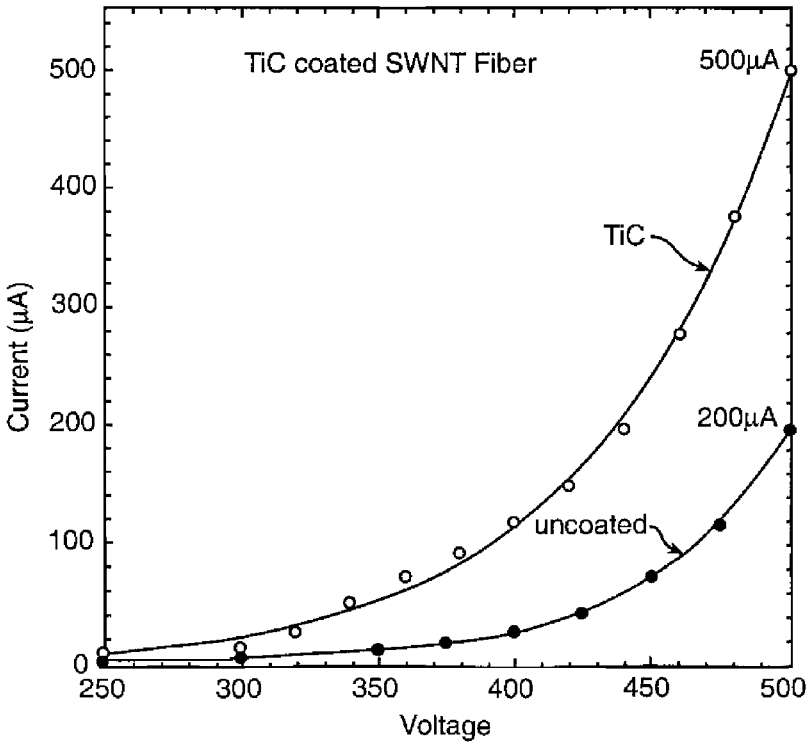
FIG. 2 is a graph showing the increased current carrying capacity of a coated fiber cathode compared to an uncoated fiber cathode.
Figure 3:
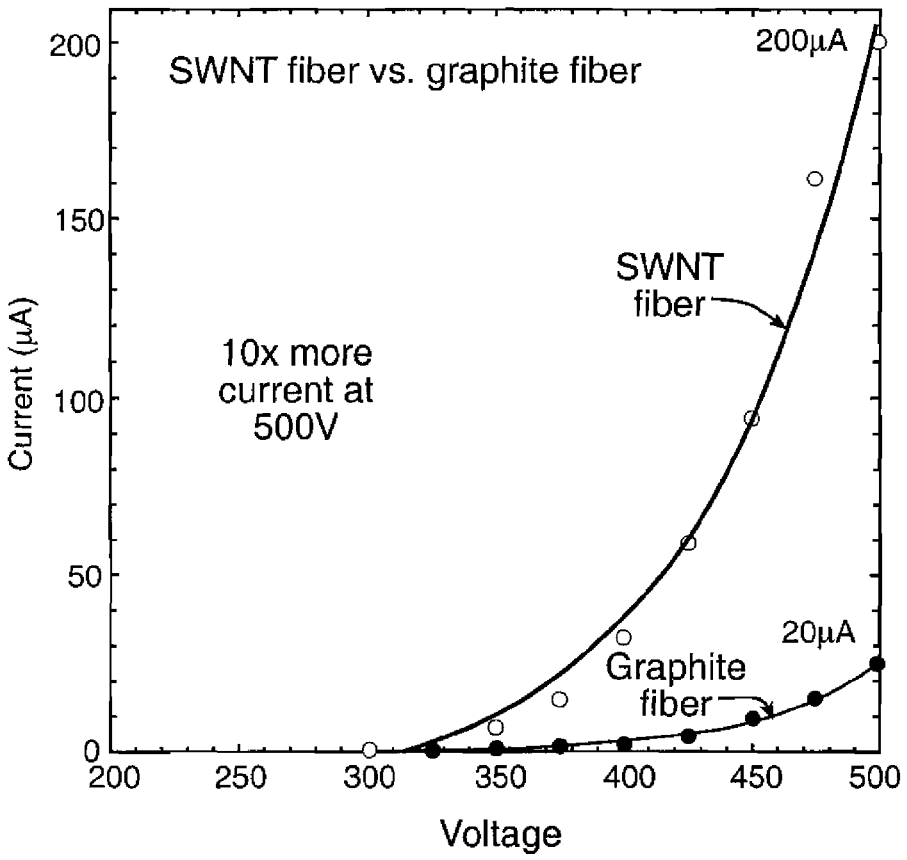
FIG. 3 is a graph showing the increased current carrying capacity of a coated fiber cathode compared to a graphite cathode.

The fiber 100 also can be treated with a low work function coating that lowers the turn-on voltage and enhances performance, enabling it to emit more current at lower voltages. Exemplary coatings including coatings made from caesium iodide (CsI), hafnium carbide (HfC), titanium carbide (TiC), lanthanum hexaboride ($LaB_6$), or boron nitride (BN) materials. Other materials may be used as coatings to lower the work function of the fiber 100. The coatings can be applied by pulsed laser deposition or other methods. By reducing the voltage threshold at which the fiber 100 can emit an electron into a vacuum, the fiber 100 can produce more current at reduced voltages thereby improving its efficiency. The dramatic improvement in performance obtained from these fibers can be seen in FIG. 3, which compares an uncoated SWNT fiber to a conventional graphite fiber. As shown in FIG. 3, an uncoated SWNT fiber cathode produces almost ten times the current of a conventional graphite cathode at about 500 V. The use of a low work function coating provides further improvements in performance, as shown by a comparison of an uncoated SWNT fiber and a coated SWNT fiber in FIG. 2. As shown in FIG. 2, a coated SWNT fiber cathode produces around two-and-a-half times more current than an uncoated SWNT fiber cathode at around 500 V.

Figure 4:
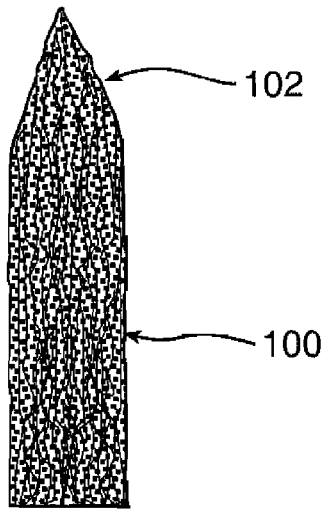
FIG. 4 shows a fiber cathode with a machined tip.
Figure 5:
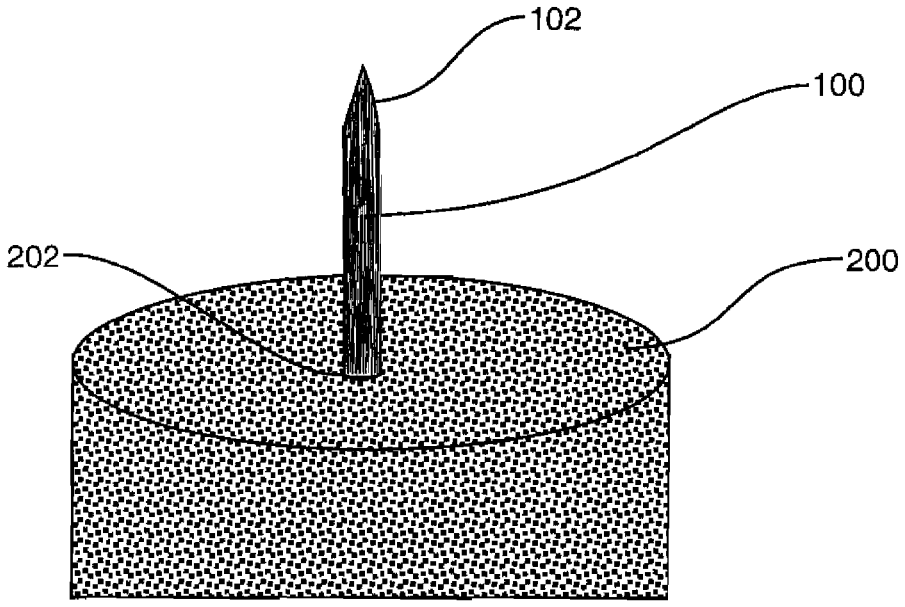
FIG. 5 shows a fiber cathode mounted to a rod.
Figure 6:
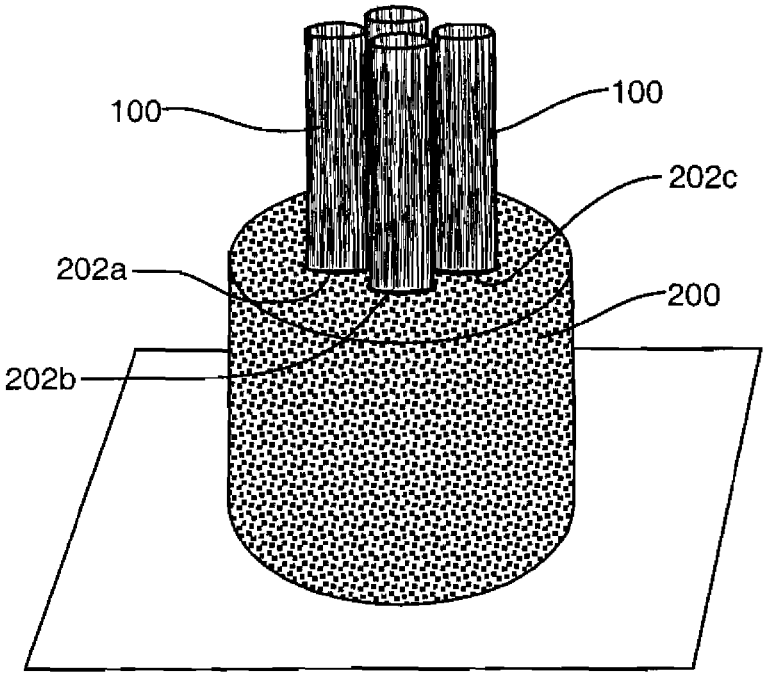
FIG. 6 shows a multi-fiber cathode arrangement.
Figure 8:
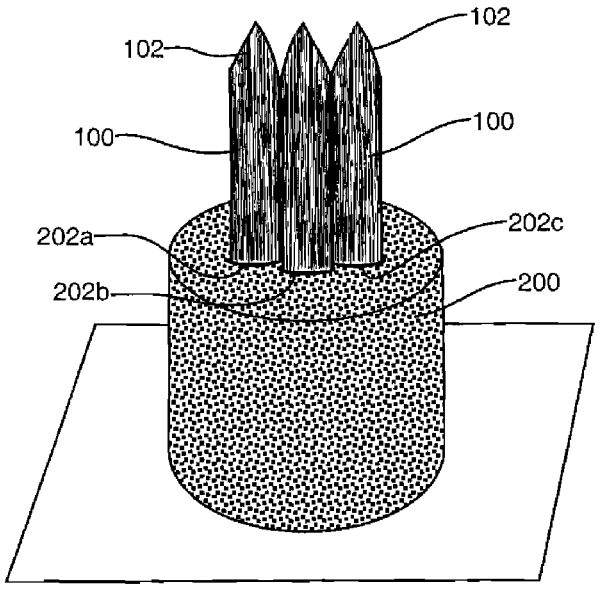
FIG. 8 shows another multi-fiber cathode.

A tip can be formed at one end of the fiber 100, as shown in FIG. 4. The tip 102 may be formed by laser micromachining, ion beam milling, and similar methods. Formation of the tip 102 improves the field emission properties of the fiber 100 as a cathode by creating a field enhancement factor. The tip 102 can be at tapered shape, as shown in FIGS. 4 and 5, or it can be pyramid-shaped, dome-shaped, or another shape that creates a field enhancement factor. The fiber 100 can be mounted on a variety of conductive materials such as a graphite rod 200, as shown in FIG. 5. This can be accomplished by machining a hole 202 in the rod 200 and inserting and securing the fiber 100 in the hole 202 with a conductive material such as for example a silver epoxy or a silver paint. A plurality of fibers 100 may be mounted on a single graphite rod or conductive post 200 to form a multi-fiber cathode, as shown in FIGS. 6 and 8. This can be accomplished, for example, by forming a plurality of holes 202*a*, 202*b*, 202*c*, 202*n* in the post 200 and securing a fiber 100 in each hole 202*a*, 202*b*, 202*c*, 202*n* with a conductive adhesive such as silver paint or silver epoxy. A tip may be formed on the end of each fiber 100 of a multi-fiber cathode, as shown in FIG. 8. The tips 102 may be tapered as shown in FIG. 8, or pyramid-shaped, dome-shaped, or other shape that creates a field enhancement factor.

Figure 7:
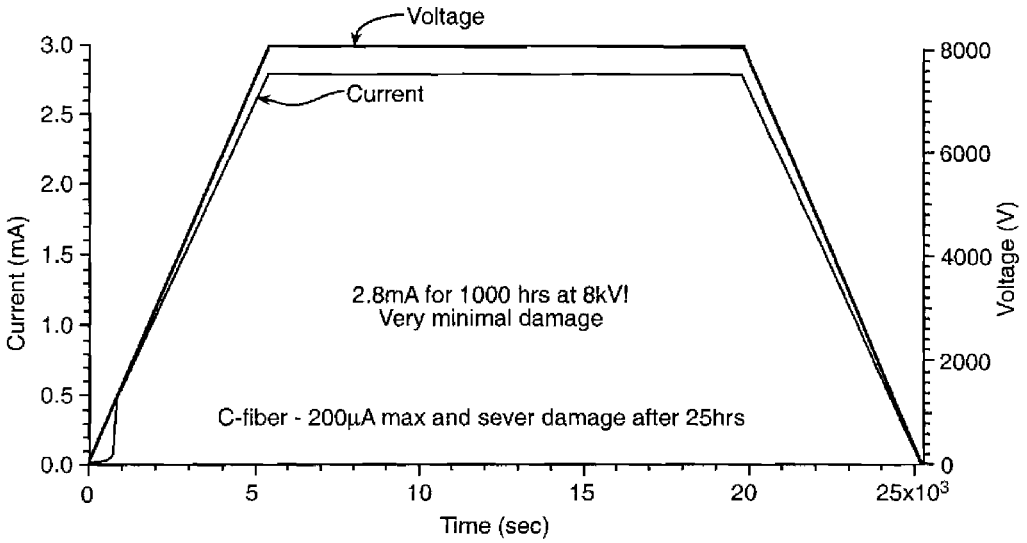
FIG. 7 is a graph of the high voltage and current stability of a fiber cathode.

Cathodes formed from these fibers handle significantly greater current density than carpets, forests, films, graphite fibers, and other known materials. They also have a lower threshold or turn-on voltage than these other materials. As shown in the graph in FIG. 7, a cathode comprising a SWNT fiber as disclosed herein produced a beam current of 2.8 mA and a beam diameter of 100 μm for 1000 hours of operation at 8 kV with very minimal damage to the fiber cathode, whereas a graphite carbon fiber cathode produced only 0.2 mA, which is insufficient for high energy applications, while experiencing severe damage after only 25 hours of operation.

The disclosed fibers can be used in a wide variety of high energy applications including production of small diameter, high current density electron beams required for high frequency traveling wave tube (TWT) amplifiers and similar applications. They can produce around 3 mA of current from an applied voltage of 8 kV and operate for hundreds of hours with minimal physical damage and little degradation in their structural integrity and performance. In one example, a single 50 micron diameter fiber emitted up to 2.5 mA, which is an increase in performance by factor of over 1500 over known carbon nanotube cathodes, which typically require an area of around 500×500 microns to emit 2.5 mA. The fibers also find use in plasma display screens, arrayed nano-vacuum electronics and field emission applications generally. Planar or conformally-coated nanocarbons are well-suited for these multi-emitter applications.

Figure 9:
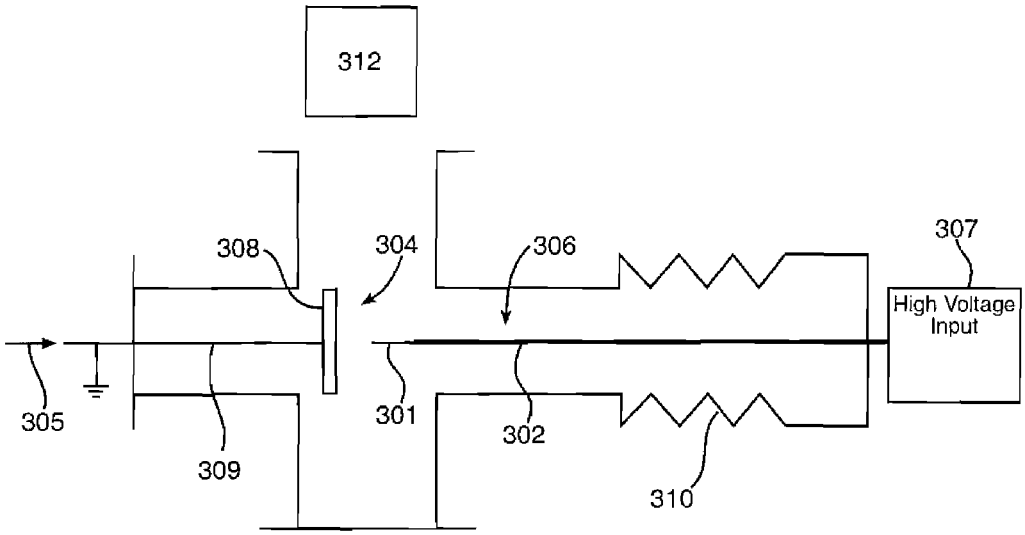
FIGS. 9 and 10 show a fiber cathode in a field emission test apparatus.
Figure 10:
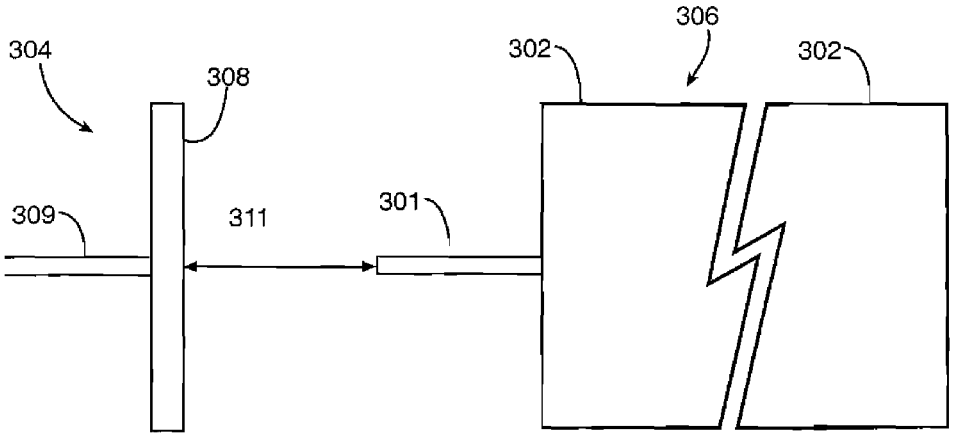

To demonstrate the greatly improved performance of the fibers as cathodes and their potential for use as cathodes in a direct current (DC) mode in vacuum electronics such as a TWT amplifiers and other high energy applications where cathodes must operate for hundreds and thousands of hours with less than a 0.5% current fluctuation, the fibers were arranged in an anode-cathode air vacuum gap arrangement show in FIGS. 9 and 10. In one example, a SWNT fiber 301 having a diameter of about 100 μm was mounted in a graphite rod 302 measuring about 2 mm in diameter. A hole of about 300 μm diameter and 3 mm depth was micromachined into the graphite rod 302 with a laser. A Lumera SuperRAPID solid state neodymium vanadate (Nd:YVO4) pulsed laser with a 12 pico-second pulse duration was used to laser micromachine the hole in the graphite rod 302. The SWNT fiber 301 was mounted in the hole with a conductive adhesive such as a silver paint or a silver epoxy and the cathode assembly was placed in an anode-cathode (A-K) gap configuration shown in FIGS. 9 and 10. The position of the anode 304 was adjustable in an axial direction along a linear translation axis 305, while the cathode 306 could be positioned in three spatial degrees of freedom. A source of negative DC voltage 307 was applied to the cathode 306 using a computer controlled FX30N10 power supply. The anode 304 comprised a disc 308 of oxygen-free high thermal conductivity (OFHC) copper mounted on a stub that was connected to a linear translator 309 that moves the anode 304 along the linear translation axis 305. The anode 304 was connected to ground via the linear translator to complete the circuit. The cathode 306 comprised the SWNT fiber 301 mounted to the graphite rod 302. The cathode 306 was mounted in a high voltage bushing 308 so about 0.5 mm of the graphite rod 302 was exposed beyond the bushing 308. The cathode 306 was connected in series with a 30 kΩ resistor (not shown) to reduce the effects of overcurrent on the power supply 307. A voltage divider provided voltage measurements across the A-K gap 311 and a current viewing resistor was used to measure current into the cathode 306. The A-K gap 311 between the tip of the SWNT fiber 301 and the anode disc 308 was set at about 5 mm. Other gaps may be set depending on the voltage, current, and other performance characteristics. The current and voltage of the cathode 306 could be controlled independently or in concert using the Lab Assistant 1.0 software package, developed by CCT, Inc. The current was raised to 1.0 mA while the voltage was raised to 5 kV in a linear ramp over 5,400 seconds. No current was emitted initially until the voltage threshold was reached, as which point the current rose exponentially according to Fowler-Nordheim emission. The voltage was maintained at a maximum voltage of 5 kV while current was maintained at 1.0 mA for 14,400 seconds. Throughout this operation, the maximum current was limited to 1.0 mA by the current limit in the power supply. The current remained stable to within a resolution of 0.5% for many hours of operation. Following this period, voltage was reduced from 5 kV back to 0 V over a 5,400 second linear ramp. During the voltage ramp-down stage, the current limit was ramped down simultaneously and it was discovered that the SWNT fiber 301 performs best under this condition. The cathode 306 operated stably to within 0.6% with a 5 mm gap at 5 kV and 1.0 mA for hundreds of hours without any degradation or variation of performance. A turbo pump 312 was used to maintain a vacuum at the A-K gap 311.

Figure 11:
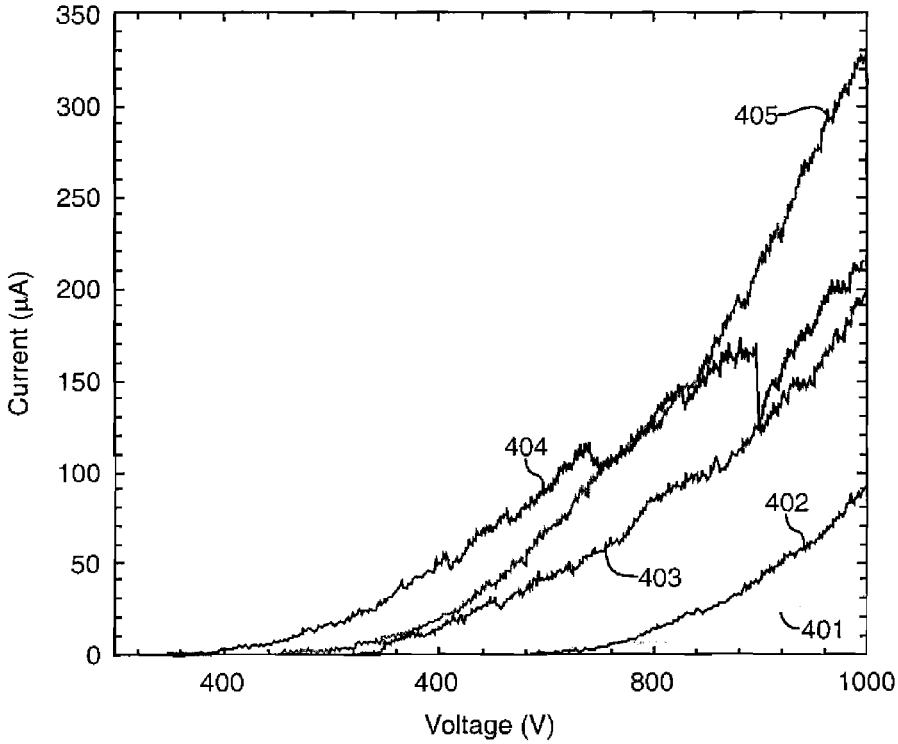
FIG. 11 shows field effect measurements of fiber cathodes with coatings.

The effectiveness of coatings was demonstrated by using cesium iodide (CsI) coatings on SWNT fibers. Field emissions were measured from 100 μm diameter SWNT fibers that included CsI coatings of varying thicknesses and the field emissions were compared to one another and to an uncoated SWNT fiber. Coatings of 10 nm, 15 nm, 20 nm, and 25 nm thickness were applied to a SWNT fiber and current was measured as voltage was ramped up from 0 V to 1,000 V. As shown in FIG. 11, the SWNT fiber with a 15 nm thickness coating 405 produced a current of about 325 μA at 1,000 V. This represented around a 3.6-fold improvement over an uncoated fiber 402, which produced about 90 μA at 1,000 V. The SWNT fiber with a 20 nm coating of CsI 404 produced the next highest current, providing a current of about 215 μA at 1,000 V. The SWNT fiber with a 10 nm coating of CsI 403 also showed large increase in current, producing about 190 μA at 1,000 V. Only the SWNT fiber with a 25 nm CsI coating 401 produced less current than an uncoated SWNT fiber. The CsI coatings also reduced the threshold voltage at which the SWNT fibers emitted current compared to the uncoated fiber 402. The SWNT fiber with a 20 nm CsI coating 404 emitted 10 μA at around 440 V, while the uncoated SWNT fiber 401 emitted 10 μA at around 800 V. These results show the effectiveness of low work function coatings in reducing the applied voltage required for the SWNT fibers to emit electrons and increasing the current that is emitted by the fibers at any particular voltage, thereby improving the efficiency of the fibers. This reduction in operating voltage due to the low work function CsI coating leads to more efficient cathode operation by producing the same current level at almost half of the voltage required for an uncoated fiber.

Figure 12:
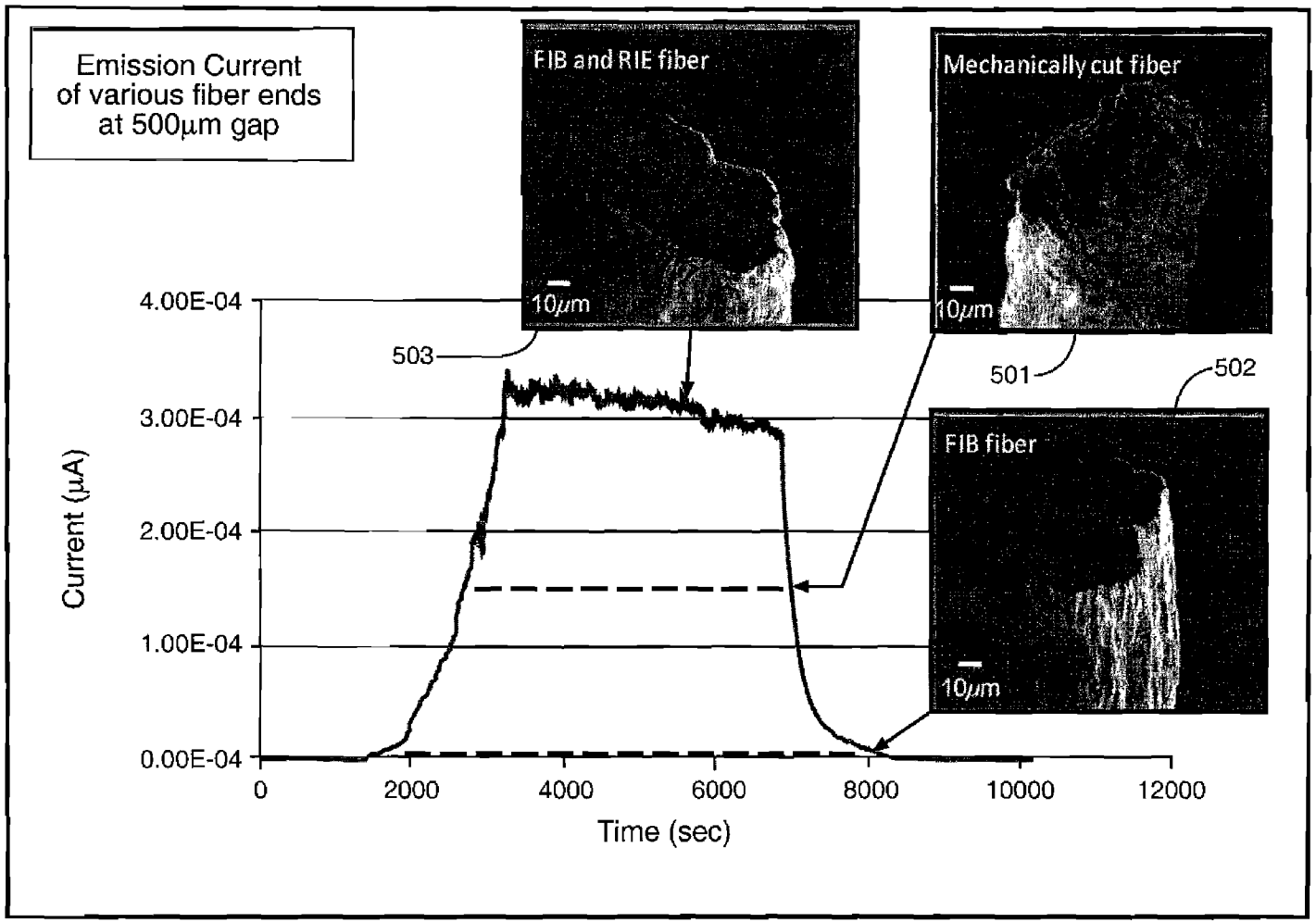
FIG. 12 shows field effect measurements of fiber cathodes with tips.

The ends of the fibers can be formed into a variety of tip shapes, including tips of a generally flat or planar surface, tapered tips, pyramid-shaped tips, dome-shaped tips, and other shapes that enhance field effects. In one example shown in FIG. 12, the tips of SWNT fibers were milled differently and current was measured from each fiber. The tip of one fiber was mechanically cut 501 by a razor. The tip of another fiber was processed with focused ion beam (FIB) milling 502 to provide a generally planar surface across the tip. The tip of a third fiber was formed with FIB milling and reactive ion etching (FIB/RIE) 503 to provide a generally planar surface. The diameter of each fiber was about 100 μm and each fiber was placed in a 500 μm A-K gap. When voltage was ramped up from 0 V to 1000 V over 3000 seconds, the FIB fiber 501 did not emit any current because FIBing the tip of the fiber produces an amorphous, redeposited layer of carbon that negates the emission properties of the SWNT fiber. A low energy Reactive Ion Etch (RIE) using an oxygen plasma was subsequently used to remove this carbon layer. After the RIE was completed, the FIB/RIE fiber 503 was tested under the same conditions and emitted 300 mA. This improvement represents a two-fold increase over the razor-cut fiber 501. The use of tapered, pyramid, and dome-shaped tips on the fibers yields further improvements in emissions due to the field enhancement factor.

The improved performance characteristics of the carbon nanotubes as cathodes also can be realized by using them as coatings on cathodes. For example, a thin film of densely-packed single-wall carbon nanotubes, double-wall carbon nanotubes, multi-wall carbon nanotubes, graphene nanoribbons, and/or carbon nanofibers may be used as cathode coatings to improve performance. For example, pyramidal tips may be configured on a silicon wafer. The pyramidal tips can be formed on the surface of the wafer by etching or other means to provide an array of pyramidal-shaped tips. A thin coating of densely-packed single-wall carbon nanotubes, double-wall carbon nanotubes, multi-wall carbon nanotubes, graphene nanoribbons, and/or carbon nanofibers (nanocarbons) may be applied to each tip of the array to enhance the field emissions of each cathode via the Fowler-Nordhiem effect. The pyramidal tips provide a field enhancement factor, causing field lines to concentrate at the tips. The carbon nanotube coating may be applied by lithographic etching or by depositing a conformal film onto the pyramidal structures. Emissions occur from the carbon nanotube coating on each pyramid. The cathodes can be formed as other shapes that concentrate field lines and they can be formed on other substrates and the carbon nanotube coatings can be applied to those cathode arrays to enhance their field emissions. These cathode arrays may be manufactured easily because the silicon (or other substrate) can be easily formed into pyramids or other shapes that concentrate field lines and then coated with a film of single-wall, double-wall, or multi-wall carbon nanotubes, and/or graphene nanoribbons. The field emission direction of the single-, double-, and multi-wall carbon nanotubes, and graphene nanoribbons of the coating is not necessarily parallel to the direction of emission of the cathodes of the array. In this way, carpets of cathodes can be configured and coated to produce enhanced field emissions using the carbon nanotubes and nanocarbons disclosed herein.

The foregoing disclosure has been presented for purposes of illustration and description and is not intended to be exhaustive or to limit the disclosure to the devices, systems, methods, and forms disclosed herein. Persons skilled in the art will realize and appreciate that many modifications and variations are possible in light of the above teaching. For example, the fibers may be formed of other carbon nanomaterials and they may be mounted on a variety of posts and other materials to function as cathodes. Other coatings may be used to lower the work function and improve the performance and efficiency of the fibers as cathodes. Different tip shapes may be formed on the fibers to enhance their performance and efficiency as cathodes. The fibers can be mounted on many different conductive materials with many different types of conductive adhesives for use as cathodes. The fibers can be used in a wide variety of high energy applications including traveling wave tubes, plasma display screens, electron microscopy, x-ray sources, other vacuum electronic devices, teraherz sources, high power microwave tubes, and other uses that require high current densities with high brightness electron beams driven by cathodes having a long lifetime in the presence of adverse conditions such as ion back bombardment, excessive heating, and the like. The disclosed methods and associated apparatuses and their variations were described to best explain the principles of the invention and its practical applications to thereby enable other persons skilled in the art to make and use the invention in its various forms and with its various modifications as are suited to the particular uses contemplated. The scope of the invention is to be defined by the following claims.

What is claimed is:

1. An improved field emission cathode for high energy applications comprising:

a fiber of densely-packed carbon nanotubes that are highly aligned along a longitudinal axis of the fiber;

a low work function coating that is applied to the fiber; and a tip that is formed at one end of the fiber, wherein the nanotubes have a density of about 50% to about 100%.

2. The improved field emission cathode of claim 1, wherein the low work function coating comprises a CsI, HfC, TiC, $LaB_6$, or BN material.

3. The improved field emission cathode of claim 1, wherein the nanotubes comprise single-wall carbon nanotubes, double-wall carbon nanotubes, multi-wall carbon nanotubes, graphene nanoribbons, carbon nanofibers, and/or planar carbon structures.

4. The improved field emission cathode of claim 1, wherein the nanotubes have a density of about 75% to about 100%.

5. The improved field emission cathode of claim 1, wherein the fiber can emit 300 mA of current at 1000 V for hundreds of hours without any degradation in the fiber or current.

6. The improved field emission cathode of claim 1, wherein the fiber is used as a cathode in a traveling wave tube amplifier or a plasma display screen to provide increased current at lower voltages and enhance performance.

7. The improved field emission cathode of claim 1, wherein the fiber is 10 to 400 microns in diameter and a density of 50-100%.

8. The improved field emission cathode of claim 1, wherein the tip is formed in a tapered shape, a pyramid shape, a planar shape, or a dome shape.

9. The improved field emission cathode of claim 1, further comprising a plurality of fibers.

10. The improved field emission cathode of claim 1, wherein the fiber is formed by spinning carbon nanotubes, graphene nanoribbons, and/or carbon nanofibers from superacid solutions to densities of about 50% to about 100%.

11. An improved cathode array comprising:

a substrate;

a plurality of cathodes formed on one surface of the substrate; and a coating of carbon nanotubes which covers a tip of each cathode, wherein nanostructures in the coating of carbon nanotubes are not aligned with a field direction of the plurality of cathodes.

12. The improved cathode array of claim 11, wherein the carbon nanotube coating comprises a thin film of densely-packed single-wall carbon nanotubes, double-wall carbon nanotubes, multi-wall carbon nanotubes, graphene nanoribbons, carbon nanofibers, and/or planar carbon nanostructures.

13. The improved cathode array of claim 11, wherein the cathodes have a pyramidal shape.

14. The improved cathode array of claim 11, wherein the substrate is a silicon wafer.

* * * * *